United States Patent [19]

Dubuit

[11] 4,248,149

[45] Feb. 3, 1981

[54] SILK SCREEN PRINTING MACHINE

[76] Inventor: Jean-Louis Dubuit, 74 Bd Voltaire, Paris, France, 75011

[21] Appl. No.: 935,651

[22] Filed: Aug. 21, 1978

[51] Int. Cl.[3] ..... B41L 13/18

[52] U.S. Cl. ..... 101/123; 101/124

[58] Field of Search ..... 101/123, 124, 48-51, 101/112, 114, 115, 126

[56] References Cited

U.S. PATENT DOCUMENTS 3,838,639 10/1974 Harwell ..... 101/123

FOREIGN PATENT DOCUMENTS 2739987 3/1978 Fed. Rep. of Germany ..... 101/124

*Primary Examiner*—Edgar S. Burr
*Assistant Examiner*—A. Heinz
*Attorney, Agent, or Firm*—McDougall, Hersh & Scott

[57] ABSTRACT

A silk screen printing machine wherein a screen is supported on a frame for engagement with an object to be printed. A squeegee is mounted for engagement with the screen during printing, and drive means operate to displace the screen and squeegee from the printing position after each printing operation whereby a new printing cycle can be initiated. The drive means pivots an arm which supports the squeegee. A link extends from the arm, and the link is operatively connected to the frame supporting the screen. Pivoting of the arm thereby simultaneously moves the squeegee away from the screen while moving the screen away from the object printed. The support for the screen frame is confined by a track holding the frame in a predetermined path of movement toward and away from the object printing position.

11 Claims, 9 Drawing Figures

98
102
108
94
96
72
111
76
104
110
68
66
70
100
44
44
102
132
130
128
126
124
132
120
124
128
122
132
126
120
130
128
124

SILK SCREEN PRINTING MACHINE

BACKGROUND OF THE INVENTION

This invention relates to printing machines of the silk screen type. Such machines are well-known for use in the printing of surfaces of objects of various character.

Silk screen printing machines involve the use of a printing fluid which is transferred to the surfaces of objects through a stencil screen made of silk or other suitable fabric. A squeegee is used in conjunction with the screen for forcing the ink through the screen openings.

In the operation of the machines, it is necessary to provide means for moving the object, screen and squeegee relative to each other. For example, when printing a flat, continuous surface, the screen is held in engagement with the surface, and the squeegee is moved across the screen. When printing cylindrical or oval surfaces, the object may be rotated about an axis with the screen being moved in synchronism with the rotation. In this case, the squeegee will be held stationary for achieving the ink transfer function.

In addition to the movements necessary during the printing operation, the screen and squeegee are typically moved away from the printing position after an object is printed. This permits removal of the object printed and the location of an unprinted object at the printing position. The screen and squeegee are then moved back into position for the next printing operation.

When moving the screen and squeegee away from the printing position, it is usually also necessary to move the squeegee out of contact with the screen particularly where the relative squeegee and screen positions are adjusted at the end of each printing cycle. This avoids problems with the quality of printing which would occur if the squeegee contacted the screen except during the printing operation.

Dubuit Pat. No. 3,090,300 illustrates a construction for supporting a screen and squeegee in a silk screen printing machine. In this construction, parallel spaced shafts and linkage means provide support for the screen and squeegee. One of the shafts has supporting links keyed thereto, at least one link being connected to the squeegee and separate link means connected to the screen whereby rotation of the shaft drives the links for movement of the squeegee and screen. The squeegee pivots away from the screen as the screen is moved away from an object after completion of a printing operation whereby the squeegee is out of contact with the screen at this time.

Another system for moving the squeegee and screen supports is set forth in British Pat. No. 984,204. In this instance, separate fluid-operated rams are connected to the screen and squeegee. These rams are actuated at appropriate intervals for controlling the relative movements of this structure during and between printing operations.

SUMMARY OF THE INVENTION

In accordance with this invention, a silk screen printing machine is provided with a screen on a supporting frame. The screen is mounted for movement to a printing position for engagement with an object to be printed, and a squeegee is provided for engagement with the screen during the printing operation for achieving the ink transfer function.

The invention is specifically directed to the means for supporting and moving the screen and squeegee toward and away from a printing position. The mounting means for the squeegee comprises a pivoting arm which is connected to a drive means for the machine. Typically, a drive motor will rotate cam means with a cam follower being operatively connected to the arm whereby the arm operates to move the squeegee toward and away from a printing position.

The pivoting squeegee support arm has a link means associated therewith. This link means is connected to the frame supporting the silk screen. The link means provides the connection between the squeegee and the screen whereby the vertical movements of the screen and squeegee are automatically synchronized while allowing the screen to move horizontally with respect to the squeegee during printing.

The silk screen frame has attachments which are confined by track means whereby the path of movement of the screen toward and away from the printing position is controlled by the track means. The screen will ordinarily be moved toward and away from the printing position while being maintained parallel with its printing position. Since the squeegee is pivoted away from the printing position, it will be automatically separated from the screen and, therefore, contact between the squeegee and screen is avoided except during the printing operation.

DESCRIPTION OF THE PREFERRED EMBODIMENTS

Figure 1:
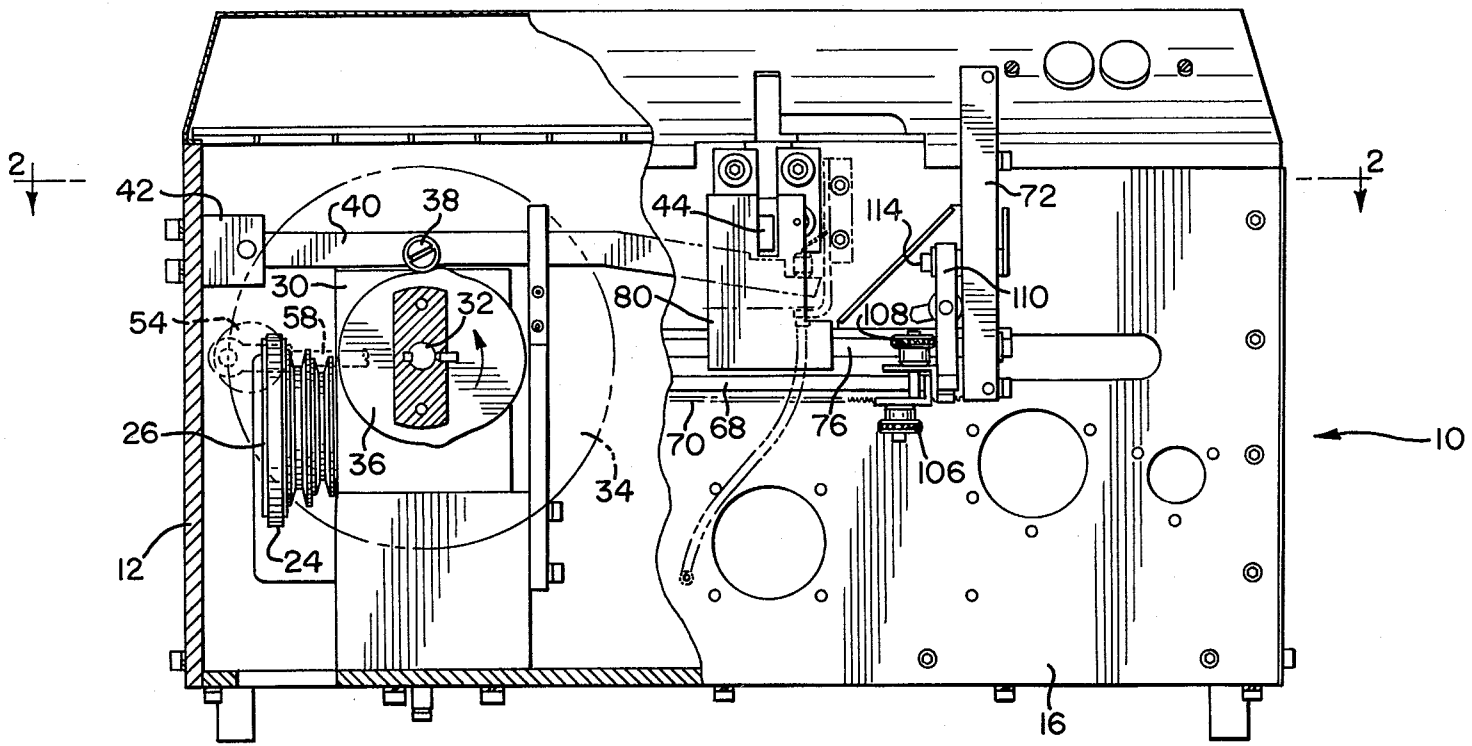
FIG. 1 is a front elevational view of a silk screen printing machine characterized by the features of this invention.
Figure 2:
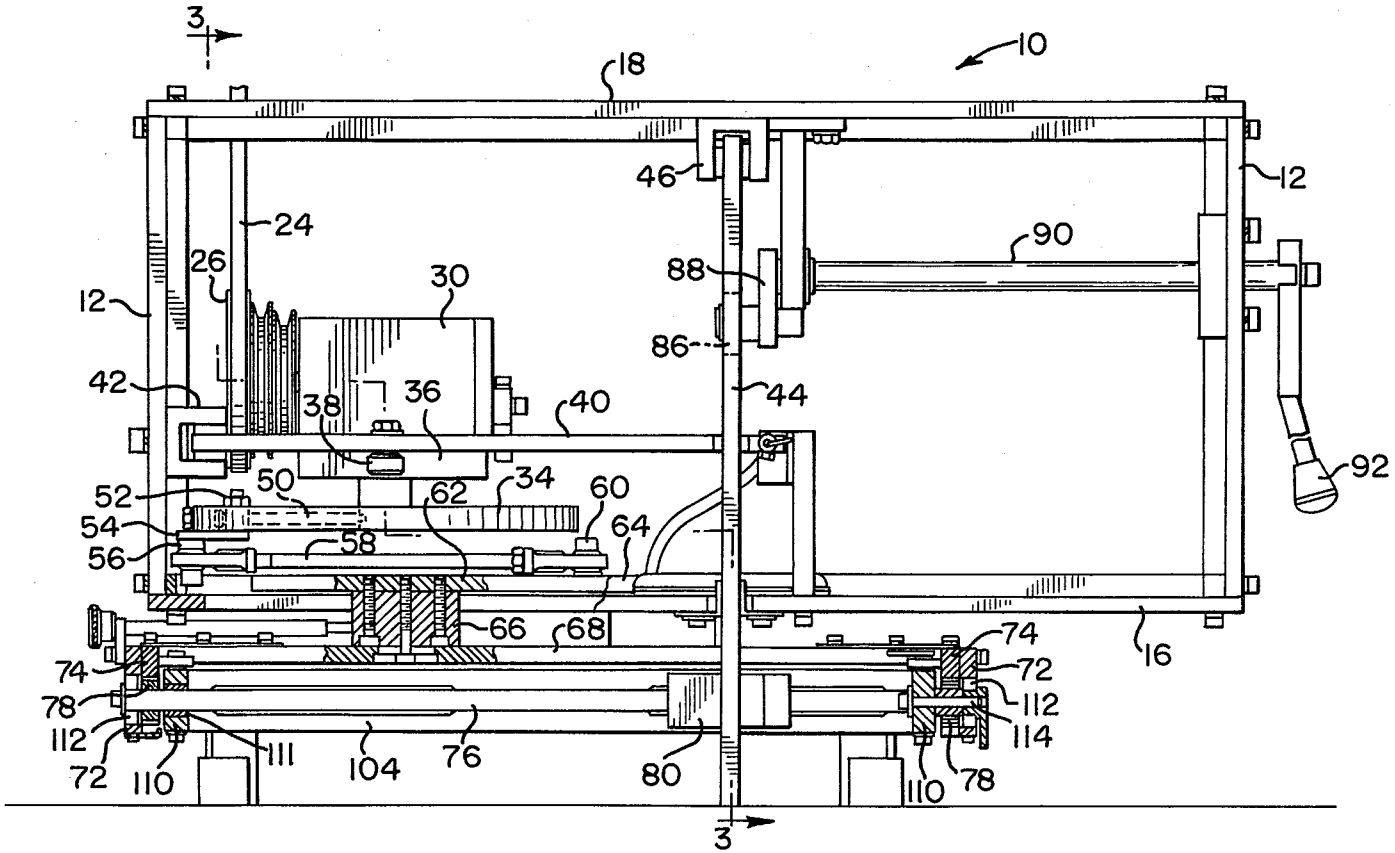
FIG. 2 is a horizontal cross-sectional view taken about the line 2—2 of FIG. 1.
Figure 3:
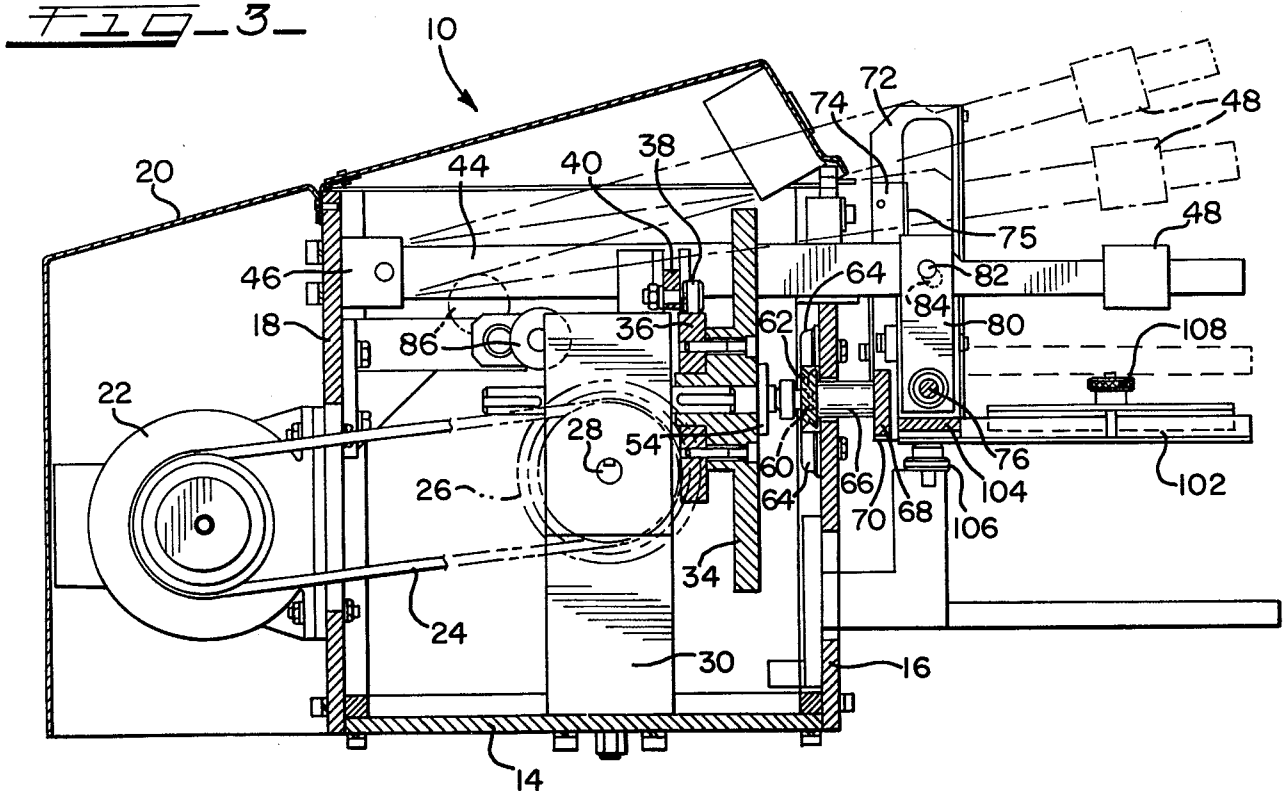
FIG. 3 is a vertical sectional view taken about the line 3—3 of FIG. 2.

FIGS. 1, 2 and 3 illustrate a machine 10 comprising a housing having side walls 12, bottom wall 14, front wall 16 and rear wall 18. An enclosure 20 is attached to the rear wall, and motor 22 is mounted on the rear wall within this enclosure.

The motor 22 supports drive belt 24 which extends to pulley 26. The pulley is keyed to shaft 28 which extends into reducer 30. The output shaft 32 for the reducer supports a drive wheel 34, and a cam 36 is bolted to this drive wheel.

Cam follower 38 is secured to a first pivoting arm 40. This arm is pivotally connected to bracket 42 secured on the side wall 12 of the machine housing.

As best illustrated in FIG. 3, the arm 40 extends transversely relative to a second arm 44. The latter is pivotally attached to bracket 46 secured on rear wall 18. A fixture 48 is attached at the end of the second arm 44 for supporting a squeegee in standard fashion. In the embodiment of the invention illustrated, this squeegee will remain stationary during a printing operation with a silk screen moving relative to the squeegee. Between pivoting operations, the squeegee is elevated as shown in dotted lines, and the elevating mechanisms will be more specifically described.

The drive wheel 34 receives the threaded shaft 50 of an adjustable supporting screw. The screw is adapted to be positioned at different locations along a radius of the wheel 34 to provide versatility in the equipment. A lock nut 52 is employed for securing the screw in a selected position.

The pin holding the lock nut 52 also supports a crank 54 which is freely rotatable around the head of the pin. This crank carries an outwardly extending support 56 which rotatably supports crank arm 58. The opposite end of the crank arm is attached by means of pin 60 to slide 62. This slide is confined between upper and lower tracks 64 which may support bearings for free movement of the slide therein.

A fixture 66 is bolted to the slide, and this fixture secures the slide to rack 68. This rack defines teeth 70 along a lower edge, and these teeth serve to drive the object to be printed as will be more specifically explained with reference to FIG. 6.

A pair of supports 72 are fixed at the opposite ends of rack 68. These supports have vertically extending racks 74 attached to their inner faces. Teeth 75 are formed along one edge of these racks. A rotatable shaft 76 extends between the racks, and pinions 78 are attached at the end of this shaft.

The shaft 76 is received within a link 80 which extends downwardly from arm 44. A pin 82 is carried by the arm, and this pin extends into grooves 84 defined by opposite interior side walls of the link. The link 80 is free for movement along the length of shaft 76 and is also free to pivot about the shaft as the arm 44 is raised and lowered. The grooves 84 and associated pin 82 facilitate free movement of the assembly of arm 44 and link 80.

Also associated with arm 44 is a separate roller 86 mounted on arm 88. The arm 88 is tied to shaft 90 which in turn extends through housing wall 12. Handle 92 mounted on the end of shaft 90 provides a means for driving roller 86 manually against arm 44. Accordingly, the arm can be moved independently of cam 36 which enables raising of the squeegee and screen away from the printing position at any time.

Figures 4, 5, 6:
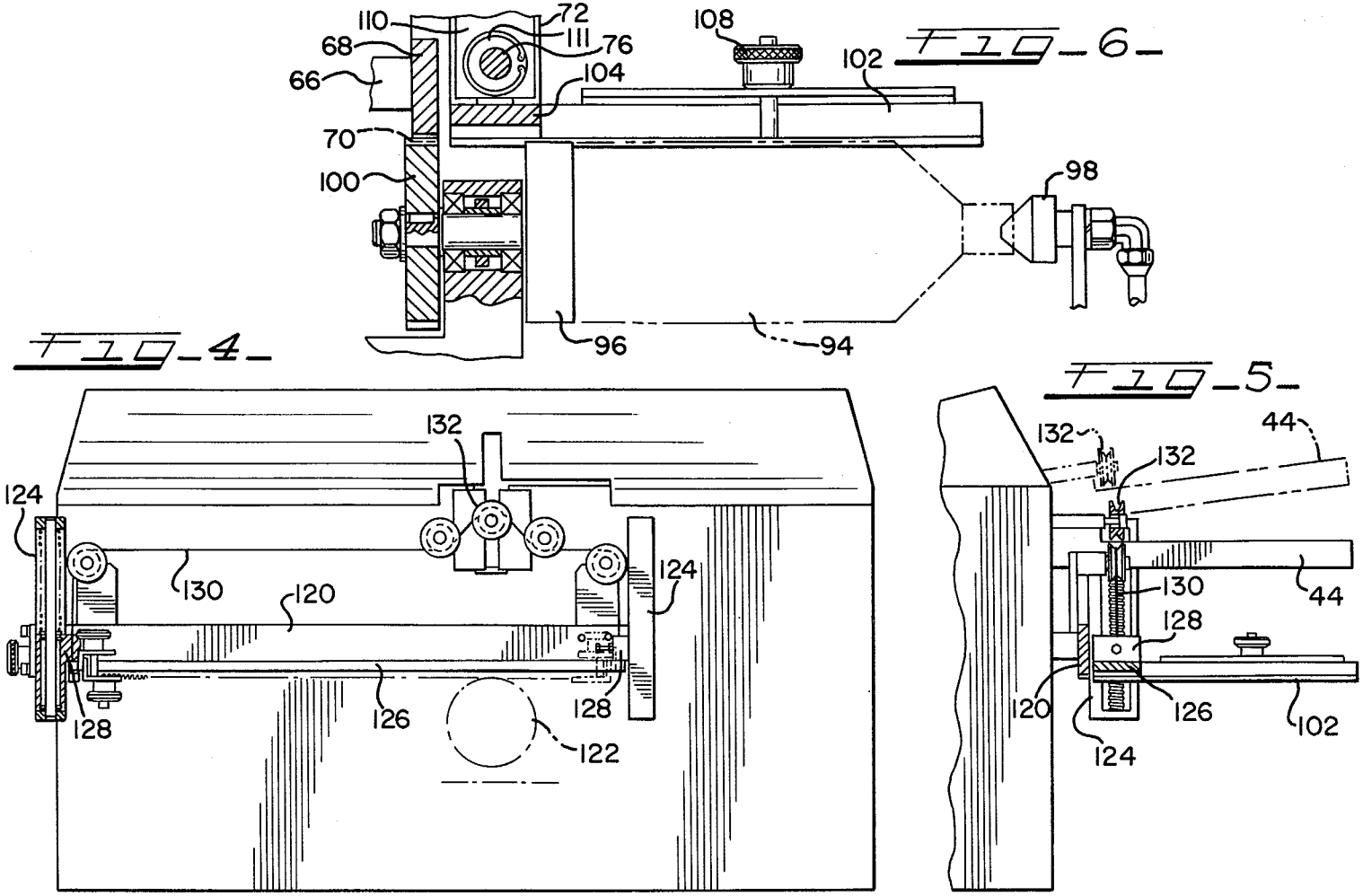
FIG. 4 is a front elevational view of a machine embodying an alternative form of the invention.
FIG. 5 is a fragmentary side elevational view of the structure shown in FIG. 4.
FIG. 6 is a fragmentary, detailed view illustrating means for supporting and driving an object to be printed in machines of the type described.

In the operation of the construction, an object 94 is positioned as illustrated in FIG. 6. Typically, the object is held between rotary mandrel 96 and oppositely positioned rotary mandrel 98. Any suitable means may be provided for opening and closing the mandrels whereby the object 94 may be readily located in position and readily moved after printing. Gear 100 is connected to mandrel 96, and this gear engages the teeth 70 of rack 68 whereby the gear is driven and the object rotated in response to movement of the rack.

The screen frame 102 comprises arms extending outwardly from plate 104. Suitable releasible clamping means 106 and 108 are associated with the screen frame in conventional fashion to facilitate mounting of the screen and adjustments thereof.

The plate 104 supports at its opposite ends members 110 and the shaft 76 extends through bearings 111 positioned in openings defined by these members. The ends of the shaft extend beyond members 110 into engagement with bearings 112 carried on supports 72. Pins 114 are also supported by members 110 and these pins have outer end portions extending into contact with bearings 112 to stabilize the members 110 relative to supports 72. Engagement of gears 78 with teeth 75 causes rotation of the shaft 76 while the shaft is moving up and down relative to the supports.

In the operation of the construction illustrated in FIGS. 1 through 3, the motor 22 is started, and objects 94 are located between mandrels 96 and 98, one at a time. The driving action continuously rotates cam 36 whereby first arm 40 will pivot up and down about its pivot point. This arm will engage second arm 44 so that this second arm will also pivot back and forth about its pivot point.

The driving action thus results in raising and lowering of the squeegee associated with fixture 48. At the same time, movement of arm 44 drives link 80 which in turn moves shaft 76 up and down. As indicated, the ends of this shaft move within bearing tracks in end supports 72. Furthermore, the pinion gears 78 mounted on the shaft mesh with racks 74 attached to the supports. It will be appreciated that this arrangement maintains precise alignment of the shaft 76 relative to the end supports irrespective of the position of the link 80 on the shaft. Thus, even if the link imparts upward or downward driving force to the shaft adjacent an end of the shaft, the gear and rack arrangement will maintain a horizontal position of the shaft axis. Shaft 76 moves in a vertical plane as controlled by arm 44 acting through link 80. The horizontal position of shaft 76 is determined by the horizontal position of rack 68 since the shaft cannot move horizontally independent of the rack. Horizontal movement of rack 68 causes a corresponding horizontal movement of the screen which allows printing on a cylindrical surface as described hereinafter.

The driving action will also rotate drive wheel 34 whereby the crank arm 58 will operate to move the slide 62 back and forth along tracks 64. Since the rack 68 is tied to the slide, and since the screen frame is tied to the rack through end supports 72, this action will drive the screen back and forth. Simultaneously, the rack 68 will rotate gear 100 for rotation of object 94 as the screen moves over the object surface. The angular velocity of the cylindrical side of object 94 is equal to the horizontal velocity of the screen. Thus, printing on a cylindrical surface of object 94 is accomplished using a two dimensional (flat) screen.

The form of the invention shown in FIGS. 4 and 5 comprises a rack 120 which may mesh with a gear 122 associated with a mandrel supporting an object to be printed. The rack 120 extends between side supports 124, and screen supporting plate 126 may include guide rollers and rack and pinion means of the type described for guiding the plate relative to the side supports. In this instance, the plate 126 supports blocks 128 which serve as means for securing the opposite ends of a link means consisting of cable 130. This cable extends over pulleys including pulley 132 which is tied to a pivoting arm of the same type as arm 44. By utilizing drive means of the type already described, the arm will raise and lower the plate 126 in response to pulley movement. Lateral movement of the screen may be imparted by a crank means of the type described.

Figure 7:
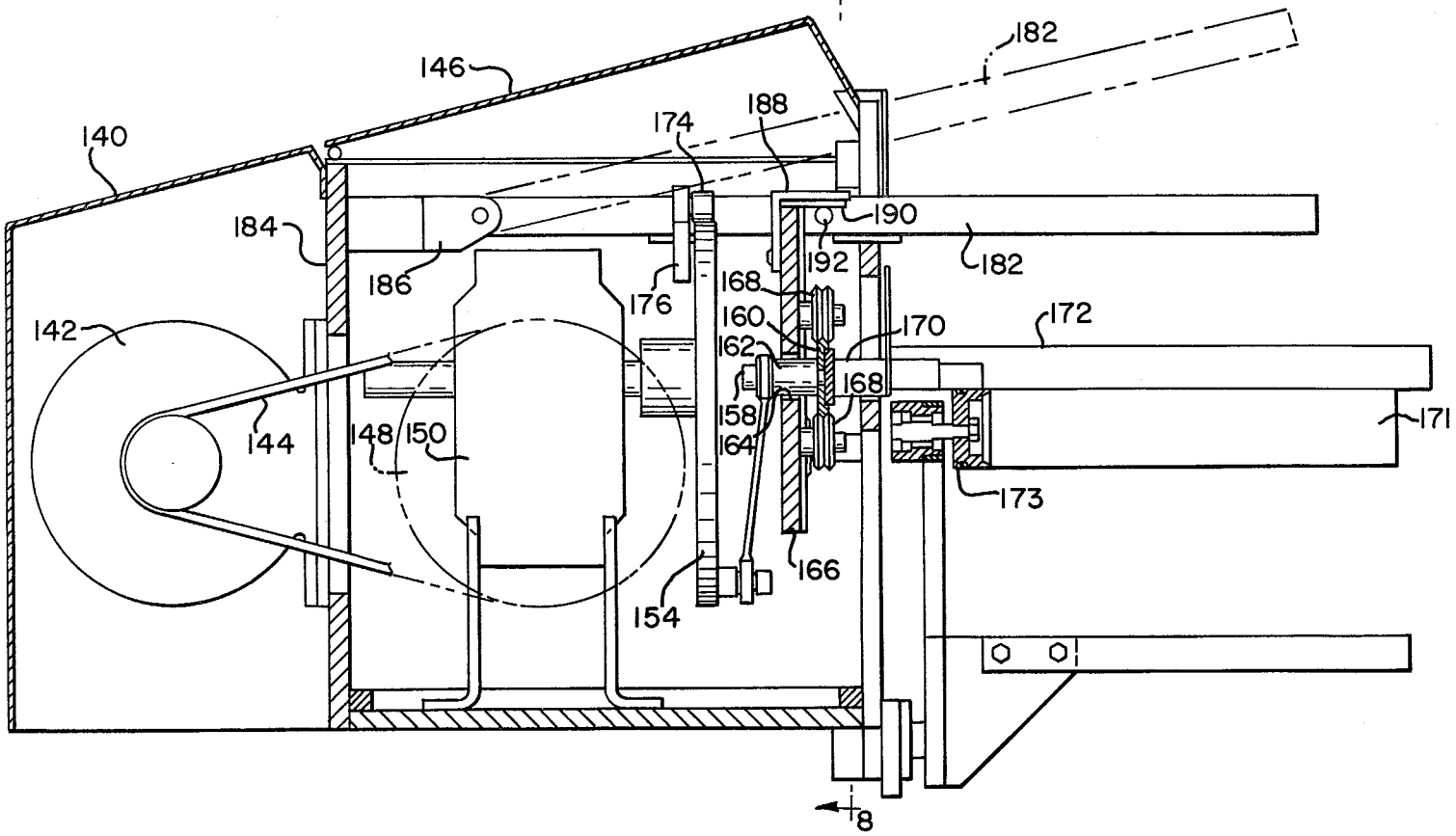
FIG. 7 is a cross-sectional view of an alternative form of the invention.
Figure 8:
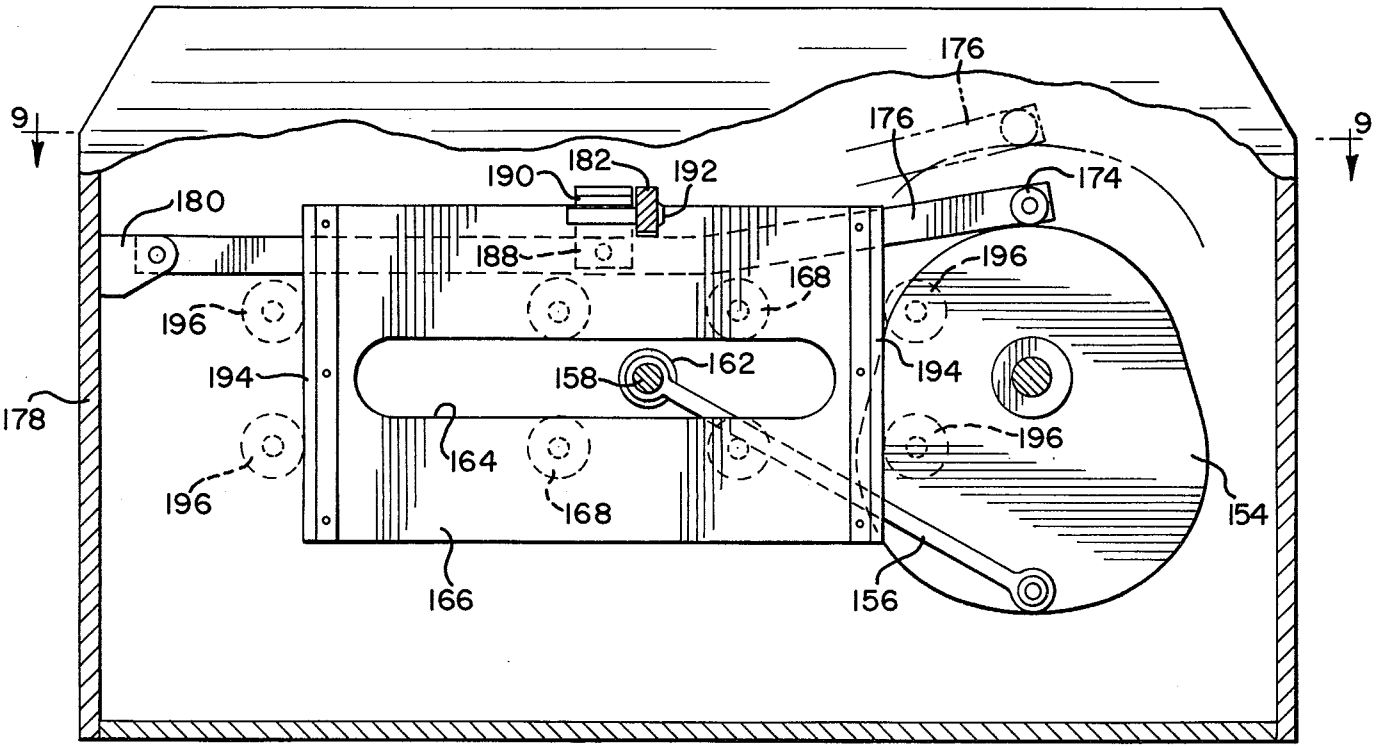
FIG. 8 is a cross-sectional view taken about the line 8—8 of FIG. 7; and, FIG. 9 is a cross-sectional view taken about the line 9—9 of FIG. 8.
Figure 9:
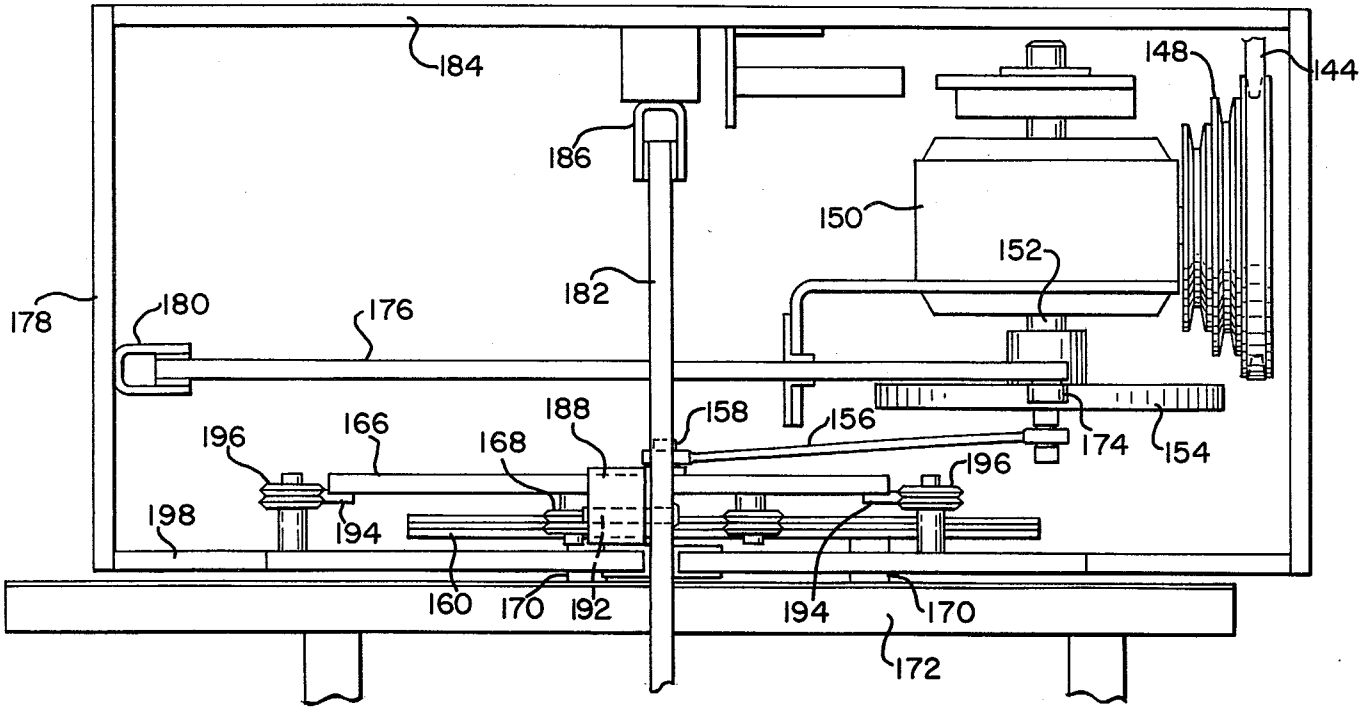

Another alternative form of the invention is shown in FIGS. 7, 8 and 9. In this construction, the rear housing 140 has motor 142 positioned therein, and the drive belt 144 extends into main housing 146. This belt is connected to pulley assembly 148 supported on a shaft which extends to reducer 150. The output shaft 152 of the reducer has a single cam 154 supported thereon.

The cam 154 drives crank arm 156. This arm is attached to pin 158, and the end of this pin is connected to slide 160. A spacer 162 is positioned around the pin 158, and this spacer is movable within slot 164 defined by plate 166.

The slide 160 defines top and bottom edges which are engaged by rollers 168 rotatably supported by plate 166. In this fashion, the slide is adapted to be driven by the crank arm back and forth relative to slot 164 as the crank arm is driven by cam 154. A pair of supports 170 extend outwardly from slide 160 for connecting the slide to the silk screen supporting frame 172. Accordingly, back and forth movement of the screen is achieved through the action of the crank arm. Cylindrical object 171 is supported on fixture 173 in conventional fashion. An alternate fixture for supporting an oval object may also be provided in accordance with known practice.

Cam follower 174 is mounted on a first arm 176 which is pivotally supported on housing wall 178 by means of bracket 180. A second pivotally mounted arm 182 is connected to housing wall 184 by means of bracket 186. As illustrated, the arm 182 is positioned above arm 176, and pivoting movement of the first arm 176 accordingly results in pivoting movement of the second arm 182.

An L-shaped plate 188 is secured to plate 166, and the horizontal leg of plate 188 supports bearing plate 190. Bolt 192 is attached to arm 182 and extends into contact with the plate 190. Accordingly, as the arm 182 pivots, the plate 166 will move vertically up and down.

A pair of guide bars 194 are attached to the side edges of plate 166, and these bars engage oppositely positioned rollers 196. The rollers 196 are fixed to housing wall 198. This arrangement provides for vertical movement in a controlled path of the plate 166 as the plate is raised and lowered in response to pivoting movement of arm 182.

As with the previously described embodiments, the arm 182 supports a squeegee. In the course of rotation of cam 154, the arm 182 and associated squeegee will, therefore, be raised and lowered. When considering the configuration of cam 154, it will be noted that the cam radius is constant for a substantial portion during which time the squeegee supporting arm 182 is lowered for engagement of the squeegee with the screen. During this time, the screen will be moved from one side to the other by the crank arm action.

As the rise in the cam 154 is encountered, the arm 176 will pivot upwardly thereby driving arm 182 upwardly to raise plate 166 and the associated screen. Upward movement of the arm 182 also moves the squeegee upwardly but at a rate faster than the screen. Accordingly, the squeegee is immediately separated from contact with the screen. This is important since the cam action will also be driving the screen sidewise through crank arm 156 to thereby return the screen to its starting position for the next printing operation.

The structure of FIGS. 7 through 9 is particularly advantageous in that a single cam is employed for driving both the screen and squeegee. The single cam particularly operates to impart both vertical and sidewise movement to the screen. The single cam also serves the important function of causing immediately separation of the squeegee from the screen surface when a printing operation is concluded and while the screen is being returned to a starting position for the next printing operation.

The constructions described provide a uniquely suitable means for controlling and synchronizing the movements of a squeegee arm and associated silk screen frame. A single drive is employed for achieving the raising and lowering of both the squeegee and screen. Furthermore, a drive wheel may be tied to a cam for rotation therewith to control reciprocal movement of the screen during a printing operation. Alternatively, a single cam is provided for achieving these functions. In any event, once the equipment has been set up for running, all the relative movements of the squeegee and screen are necessarily maintained in precise synchronism.

The invention is also characterized by drive means which are straightforward in construction whereby maintenance problems are minimized. In this connection, the screen may be supported by a pair of carriages comprising rack 68 and plate 104, each of which is characterized by a sliding movement with one carriage sliding perpendicular to the other. The assembly including plate 166 with separate guide rollers is similarly efficiently constructed, and either mode of operation is considered particularly reliable.

The utilization of pivoting arms 44 or 182 and associated linking means is also a highly reliable means for achieving both the squeegee movement and the screen movement between printing operations. Thus, the direct linkage between these structures and the fact that the same linkage achieves separation of the structures as well as movement away from the printing position, are highly desirable from the standpoint of manufacturing and operating efficiency.

It will be understood that various changes and modifications may be made in the above described construction which provide the characteristics of the invention without departing from the spirit thereof particularly as defined in the following claims.

That which is claimed is:

1. In a silk screen printing machine wherein a screen on a supporting frame is mounted for engagement with an object to be printed, a squeegee is mounted for engagement with the screen when the screen is in engagement with the object, and means are provided for moving the screen and squeegee from their respective engagements, the improvement wherein the mounting for said squeegee comprises:

a pivoting arm on which the squeegee is mounted, first drive means for pivoting said arm, said first drive means comprising a rotating cam, a second arm, a cam follower mounted on said second arm, said cam and cam follower operating to drive said second arm into contact with said pivoting arm for driving said pivoting arm, and link means extending from said pivoting arm operatively connecting said pivoting arm to said frame for controlling the movement of said frame relative to said pivoting arm, said link means comprising a horizontal rotatable shaft, track means positioned at each end of said shaft for maintaining the horizontal orientation of said shaft, cooperating means for connecting the ends of said shaft with said track means to allow movement of the shaft, and coupling means for transmitting movement of the pivoting arm to said shaft, whereby said pivoting arm is driven by said first drive means to move said squeegee away from said screen with said pivoting arm's movement transmitted through the link means to said screen frame, causing the screen to simultaneously move away from said object.

2. A machine in accordance with claim 1 including a supporting plate for said screen, guide means on the plate, a slide engaging said guide means, and means connecting the screen to the slide, said slide and screen being thereby movable relative to the plate during engagement of the screen with said object.

3. A machine in accordance with claim 2 including an opening defined by said plate, a frame support extending from said slide through said opening for connection with said frame, a crank arm connected at one end to said cam, means connecting the other end of said crank arm to said frame support, rotation of said cam driving said frame support and associated frame within said opening.

4. A machine in accordance with claim 1 wherein said coupling means comprise a coaxial link encompassing said rotatable shaft, said coaxial link attached to said pivoting arm whereby vertical movement of said arm is transmitted to said shaft without restricting said shaft's ability to rotate and move horizontally.

5. A machine in accordance with claim 1 wherein said cooperating means comprise pinions supported on said shaft ends, said track means including racks engageable by said pinions.

6. A machine in accordance with claim 1 including separate members extending from said screen frame into engagement with said shaft for connecting the screen frame to the shaft, and including means associated with said separate members for engaging said track means to stabilize said frame relative to said track means.

7. A machine in accordance with claim 6 wherein said screen frame is maintained parallel to its position during engagement with said object and during movement away from said object, said pivoting arm for supporting the squeegee causing the squeegee to pivot away from said screen as the screen moves away from the object.

8. In a silk screen printing machine wherein a screen on a supporting frame is mounted for engagement with an object to be printed, a squeegee is mounted for engagement with the screen when the screen is in engagement with the object, and means are provided for moving the screen and squeegee from their respective engagements, the improvements wherein the mounting for said squeegee comprises:

a pivoting arm on which the squeegee is mounted, frist drive means for pivoting said arm, said first drive means comprising a rotatable shaft, and including separate drive means mounted on said shaft for moving said screen frame during engagement with said object, a first carriage supporting said screen frame, a track receiving said first carriage, said separate drive means being connected to said first carriage for sliding said first carriage back and forth along said track, and link means extending from said arm operatively connecting said pivoting arm to said frame for controlling the movement of said frame relative to said arm, whereby said arm is driven by said driving means to move said squeegee away from said screen with said arm's movement transmitted through the link means to said screen frame, causing the screen to simultaneously move away from said object.

9. A machine in accordance with claim 8 wherein said separate drive means comprises a rotating wheel, a crank mounted on said wheel, and a crank arm extending between said wheel and said first carriage.

10. A machine in accordance with claim 9 including a second carriage having said screen frame attached thereto, said first carriage comprising a support for said second carriage, said link means operating to drive said second carriage in a path perpendicular to the path of movement of said first carriage.

11. In a silk screen printing machine wherein a screen on a supporting frame is mounted for engagement with an object to be printed, a squeegee is mounted for engagement with the screen when the screen is in engagement with the object, and means are provided for moving the screen and squeegee from their respective engagements, the improvement wherein the mounting of said squeegee comprises:

a pivoting arm on which the squeegee is mounted, first drive means for pivoting said arm, link means extending from said arm operatively connecting said pivoting arm to said frame for controlling the movement of said frame relative to said arm, said link means comprising a cable extending between said arm and said frame, a first carriage supporting said screen frame, a track receiving said first carriage for guiding said first carriage in one direction, a second carriage supported by said first carriage, and separate track means on said first carriage for guiding said second carriage for movement in a direction perpendicular to the direction of movement of said first carriage, whereby said arm is driven by said drive means to move said squeegee away from said screen with said arm's movement transmitted through the link means to said screen frame, causing the screen to simultaneously move away from said object.

* * * * *